US007566219B2

(12) United States Patent
Lin

(10) Patent No.: US 7,566,219 B2
(45) Date of Patent: Jul. 28, 2009

(54) BLOW TORCH BURNER

(76) Inventor: Arlo Lin, No. 68, Kung Yeh 32$^{nd}$ Road, Industrial Park, Taichung (TW)

( * ) Notice: Subject to any disclaimer, the term of this patent is extended or adjusted under 35 U.S.C. 154(b) by 126 days.

(21) Appl. No.: 11/856,094

(22) Filed: Sep. 17, 2007

(65) Prior Publication Data

US 2008/0160471 A1 Jul. 3, 2008

(30) Foreign Application Priority Data

Dec. 29, 2006 (TW) ..... 95150043 A

(51) Int. Cl.
*F23D 14/28* (2006.01)

(52) U.S. Cl. ..... 431/344; 431/255; 431/153

(58) Field of Classification Search ..... 431/153, 431/255, 344
See application file for complete search history.

(56) References Cited

U.S. PATENT DOCUMENTS 3,583,846 A * 6/1971 Kimball et al. ..... 431/142
4,157,891 A * 6/1979 Moriya ..... 431/344
5,215,458 A * 6/1993 Cirami ..... 431/277
5,564,919 A * 10/1996 Tsai ..... 431/255
5,829,963 A * 11/1998 Ichikawa ..... 431/153
6,186,774 B1 * 2/2001 Butera, Jr. ..... 431/277
6,457,628 B1 * 10/2002 Lin ..... 228/20.1
6,648,630 B2 * 11/2003 Tse ..... 431/153
7,223,097 B2 * 5/2007 Perez ..... 431/153
2003/0124476 A1 * 7/2003 Chung Yang ..... 431/153
2008/0124665 A1 * 5/2008 Aronson et al. ..... 431/6

* cited by examiner

*Primary Examiner*—Kenneth B Rinehart
*Assistant Examiner*—Frances Kamps
(74) *Attorney, Agent, or Firm*—Alan Kamrath; Kamrath & Associates PA

(57) ABSTRACT

A blow torch burner which utilizes combustion gas in which the combustion gas is maintained in a reservoir connected thereto. The blow torch burner has a valve seat having an ignition apparatus and a moveable rod therein. An adjusting member includes a first joint engaged with the rod such that said adjusting member is moveable with respect to said valve seat and a compartment. An actuator is slidably moveable in the compartment and is adapted to actuate said ignition apparatus.

13 Claims, 8 Drawing Sheets

BLOW TORCH BURNER

BACKGROUND OF THE INVENTION

1. Field of the Invention

The present invention relates to a blow torch burner.

2. Description of the Related Art

Referring to FIG. 1, a conventional blow torch includes an adjusting member 2 in which a rod 1 is disposed therein, and, the rod 1 can be longitudinally moved by rotating a control knob 4 connected thereto for controlling the amount of combustion gas flown into the adjusting member 2. In addition, by pressing the control knob 4, the control knob 4 can actuate an ignition apparatus 3 for igniting the combustion gas and therefore producing the flame.

Although by manipulating the control knob 4, the aforementioned actions can be performed. However, a problem arises when the user presses the control knob 4 to actuate ignition apparatus 3, due to the fact being the user is likely to accidentally rotate the control knob 4. Therefore, length of the flame produced can be unpredictably increased or decreased, which is dangerous. Another problem is that a first-time user may not be quickly adapted to the dual-function of the control knob 4.

The present invention is, therefore, intended to obviate or at least alleviate the problems encountered in the prior art.

SUMMARY OF THE INVENTION

The present invention overcomes the disadvantage of the prior art by providing a blow torch burner in which the liability that the user accidentally change the predetermined amount of combustion gas fed into an adjusting member during ignition process is minimized.

The blow torch burner includes a reservoir connected thereto. The reservoir is provided for maintaining combustion gas. The blow torch burner further has a valve seat having an ignition apparatus and a moveable rod therein. The rod is longitudinally moveable in the valve seat so as to dynamically control amount of combustion gas fed into the valve seat. An adjusting member includes a first joint engaged with the rod such that said adjusting member is moveable with respect to said valve seat and a compartment. An actuator is slidably moveable in the compartment and is adapted to actuate said ignition apparatus. The actuator is adapted to actuate the ignition apparatus, thereby the ignition apparatus ignites the combustion gas.

It is a primary objective of the present invention to provide a blow torch burner that the adjusting member will not be accidentally manipulated during operation of the actuator.

Other objectives, advantages, and novel features of the invention will become more apparent from the following detailed description when taken in conjunction with the accompanying drawings.

DETAILED DESCRIPTION OF THE PREFERRED EMBODIMENT

Figure 1:
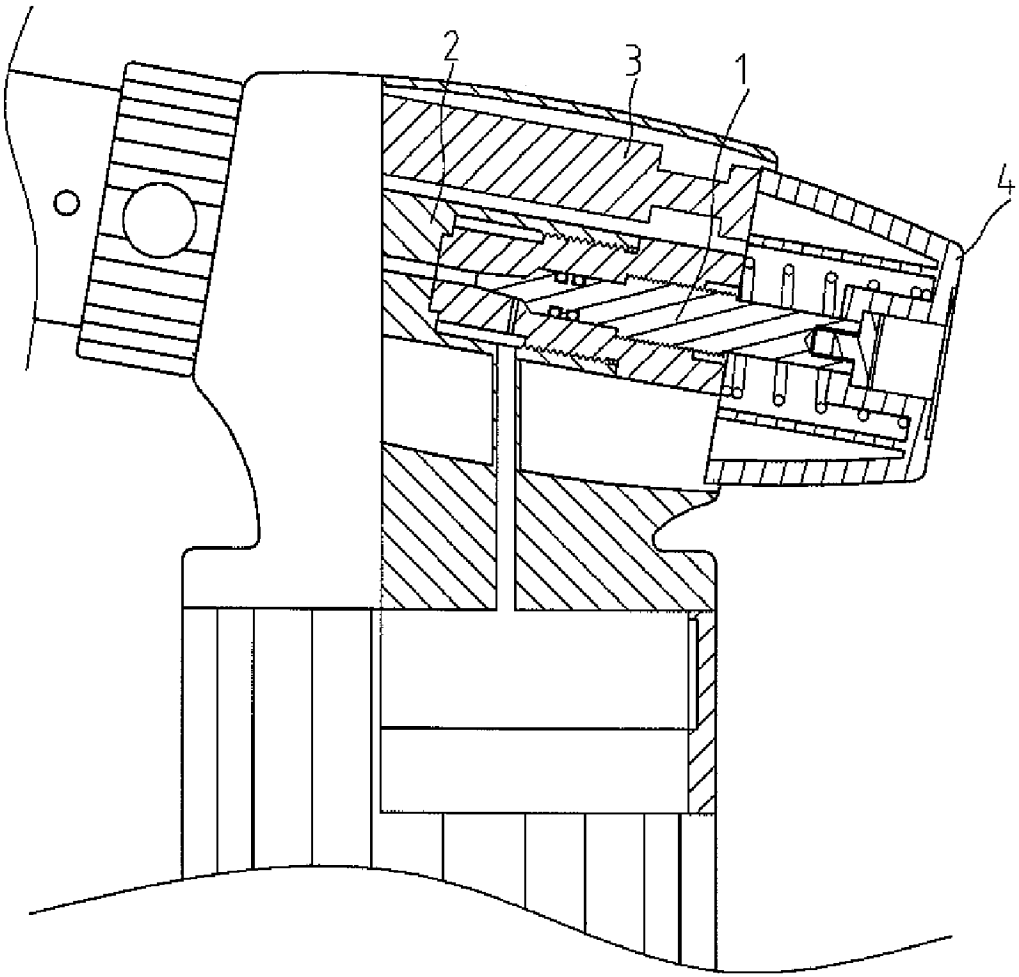
Fig.1 Prior Art
FIG. 1 is a partial, cross-sectional view of a conventional blow torch burner.
Figure 2:
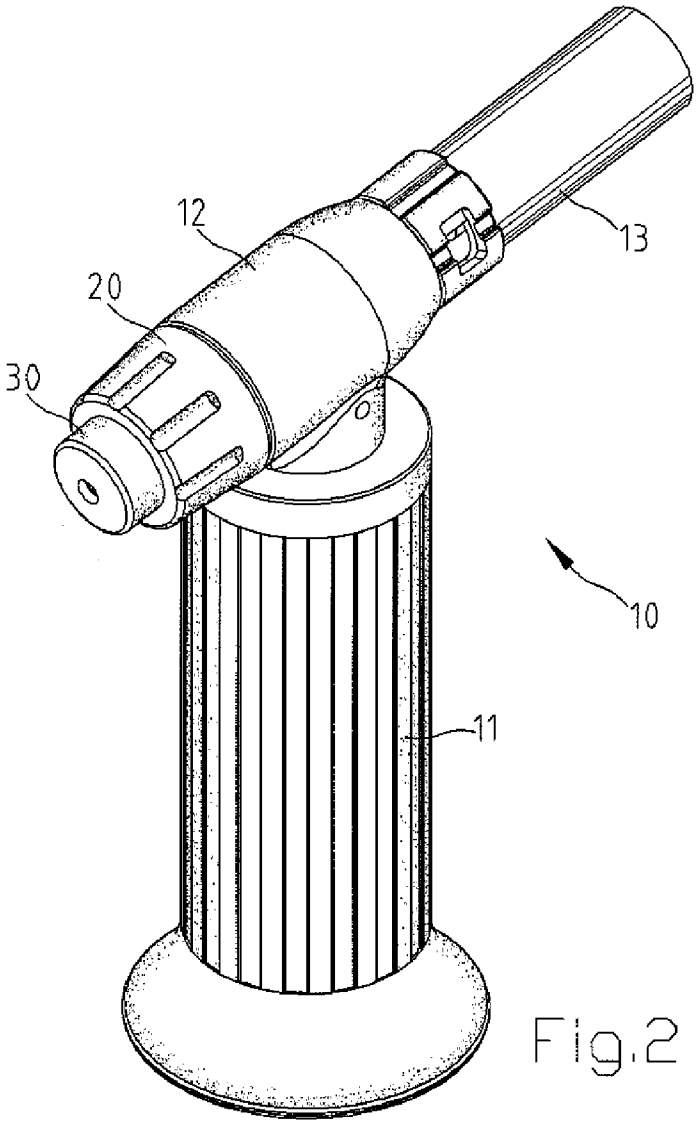
FIG. 2 is a perspective view of a blow torch burner embodying the present invention.
Figure 3:
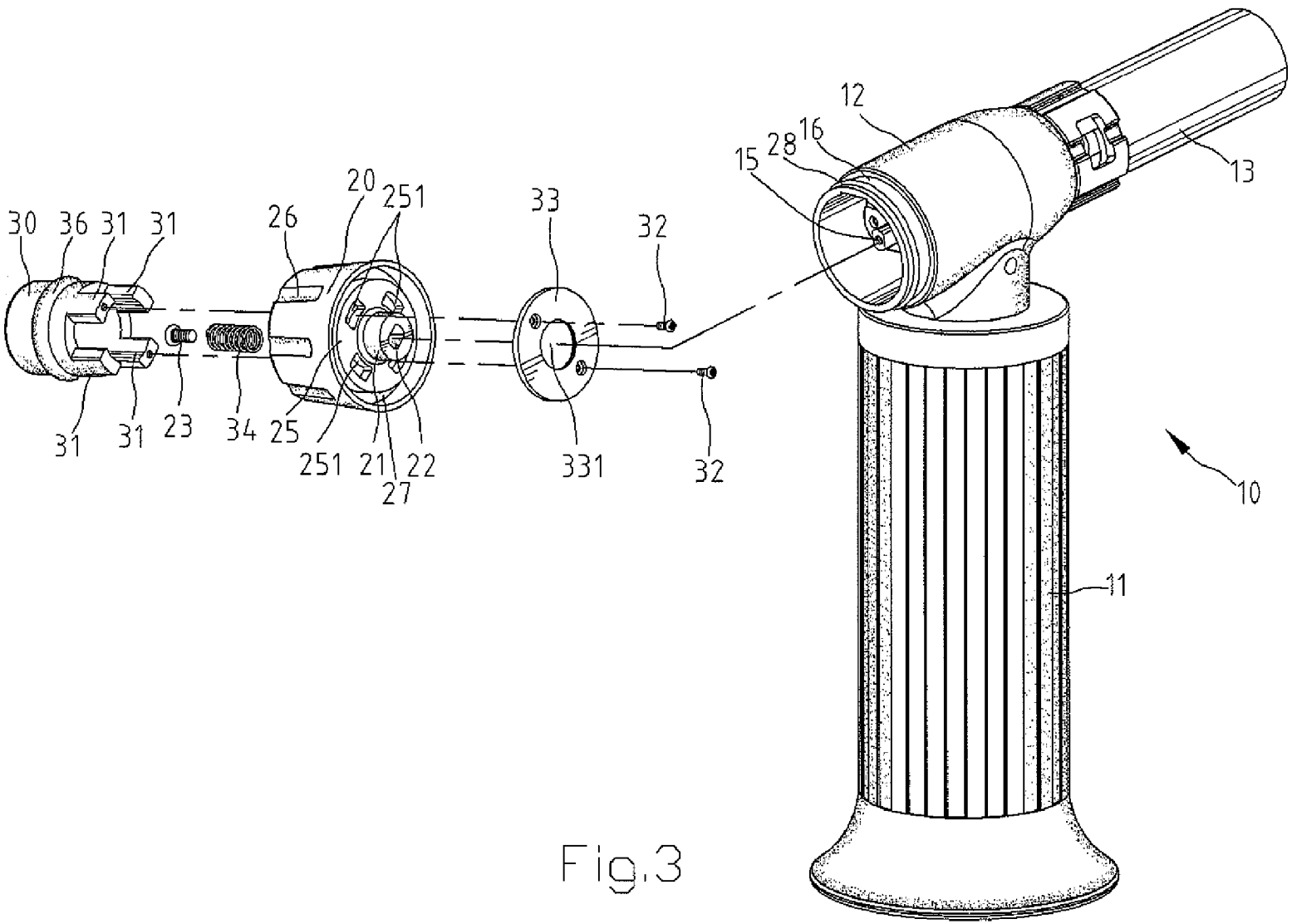
FIG. 3 is an exploded perspective view of the blow torch burner shown in FIG. 2.
Figure 4:
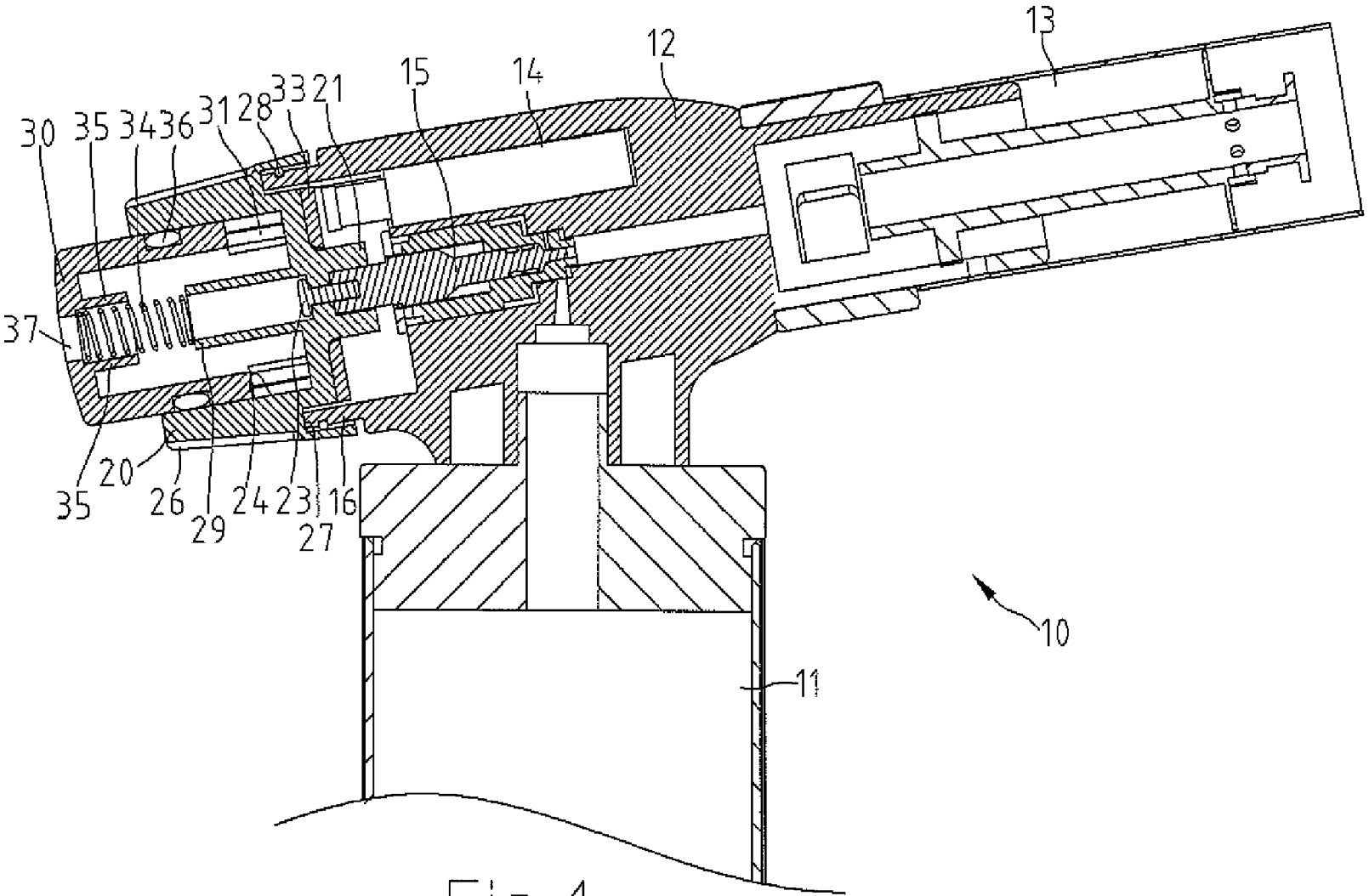
FIG. 4 is a cross-sectional view of the blow torch burner shown in FIG. 2

Referring to FIGS. 2 through 4, a blow torch burner 10 utilizes combustion gas in which the combustion gas is maintained in a reservoir 11 connected thereto. The blow torch burner 10 has a valve seat 12 having an ignition apparatus 14 for igniting the combustion gas and thereafter producing the flame. The flame is discharged from a nozzle 13 that locates in advance of the valve seat 12. The blow valve seat 12 further has a rod 15 therein. The rod 15 is longitudinally moveable in the valve seat 12 and therefore dynamically control amount of combustion gas fed into the valve seat 12. In addition, the rod 15 is engaged with an adjusting member 20, which may be rotated by the user for operatively moving the rod 15. More specifically, the rod 15 includes a portion being received in a non-circular orifice 22 of a first joint 21, in which the first joint 21 extends from a side of a wall portion 25 defined by the adjusting member 20. The wall portion 25 is transversely disposed within the adjusting member 20 such that the wall portion 25 is perpendicular to the rod 15. Furthermore, the wall portion 25 defines a section 27, which is not located in a common plane, for receiving a neck 16 formed behind the valve seat 12 when the rod 15 is engaged with the adjusting member 20. In this preferred embodiment, the neck 16 includes a friction-providing member 28 for providing a resisting force between the neck 16 and the adjusting member 20.

As best shown in FIG. 4, the wall portion 25 also includes a second joint 29 extending from an opposite side thereof than the first joint 21. A fastener 23 is allowed to be inserted through the second joint 29 for engaging with the portion of the rod 15 received in the orifice 22 of the first joint 21. Furthermore, the adjusting member 20 includes an anti-slip gripping portion 26 for assisting the user in obtaining a firm grip.

Still referring to FIGS. 2 through 4, the wall portion 25 has a compartment 24 and a plurality of through holes 251, which is radially disposed about the first joint 21, for receiving an actuator 30 and its plurality of arms 31 respectively. The actuator 30 is biasably moved in the compartment 24 by an elastic element 34. The elastic element 34 includes one end engaged with the second joint 29 and another end engaged with a joint 35 defined by the actuator 30. The plurality of arms 31 are inserted through the plurality of through holes 251 respectively and securely engaged with a pushing member 33 by fasteners 32. The pushing member 33 is adapted to be urged by the actuator 30 into a position to actuate the ignition apparatus 14, thereby igniting the combustion gas.

The actuator 30 also includes a friction-providing member 36 for providing a friction force between the actuator 30 and the compartment 24 when the actuator 30 is biasably moved in the compartment 24 of the adjusting member 20. The actuator 30 further has a through hole 37 defined thereof for allowing a driving tool (not shown) to insert through for tightening the fastener 23 that engages the adjusting member 20 with the rod 15. In this embodiment, the driving tool can be inserted through the through hole 37, then the joint 35 and then the second joint 29.

Figure 5:
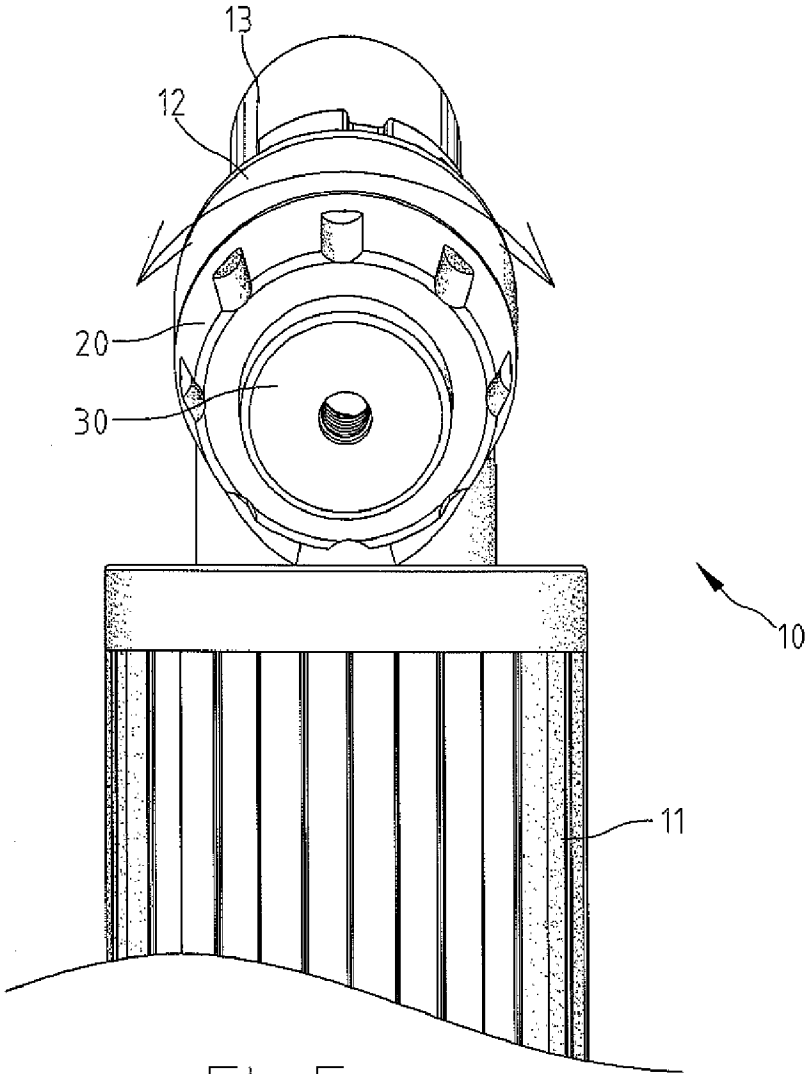
FIG. 5 is a rear view of the blow torch burner shown in FIG. 2.
Figure 7:
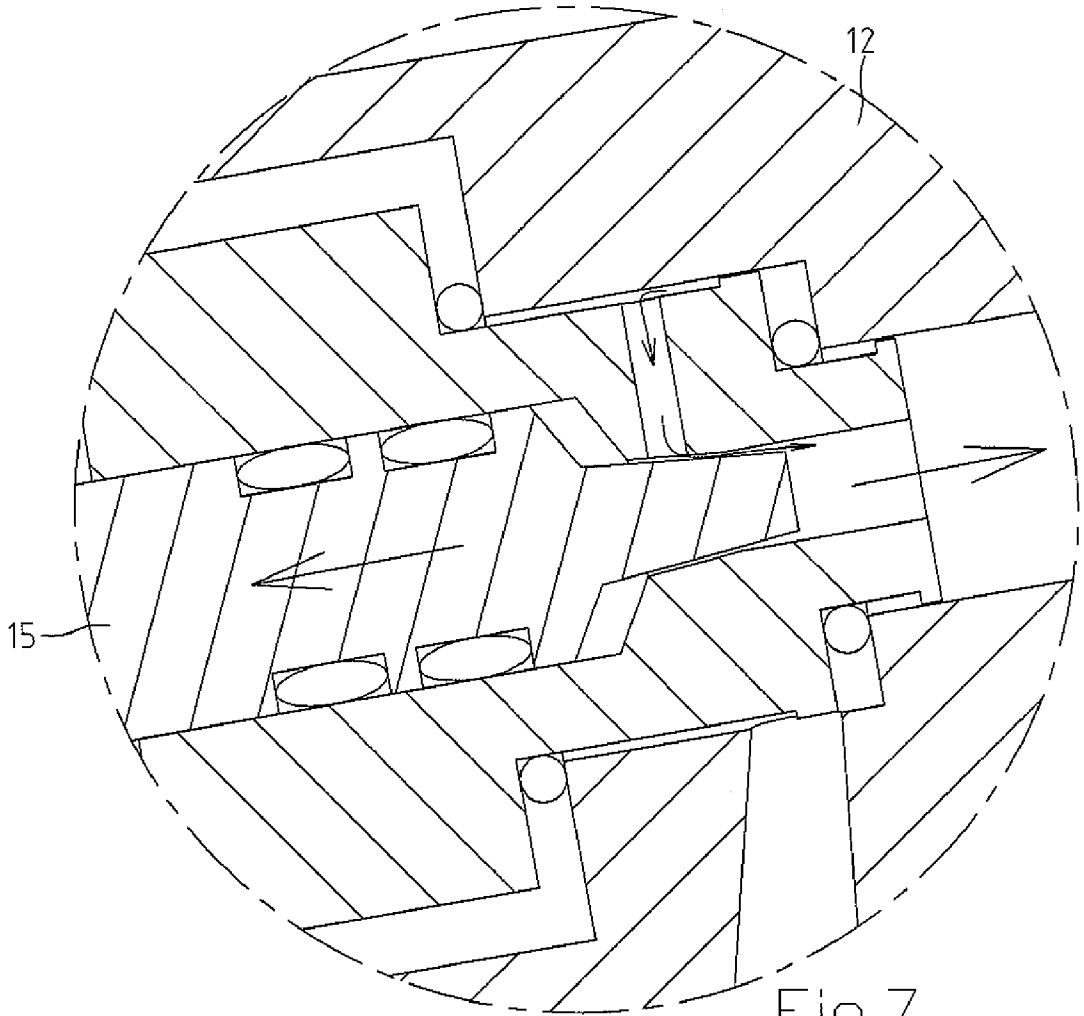
FIG. 7 is a partial enlarged view of FIG. 6.

Referring to FIG. 5 in conjunction with FIG. 7, FIG. 5 shows the adjusting member 20 adapted to be rotated clockwise/counterclockwise (as indicated by the arrow). Accordingly, the adjusting member 20 can operatively move the rod 15 for dynamically controlling amount of combustion gas fed into the valve seat 12.

Figure 6:
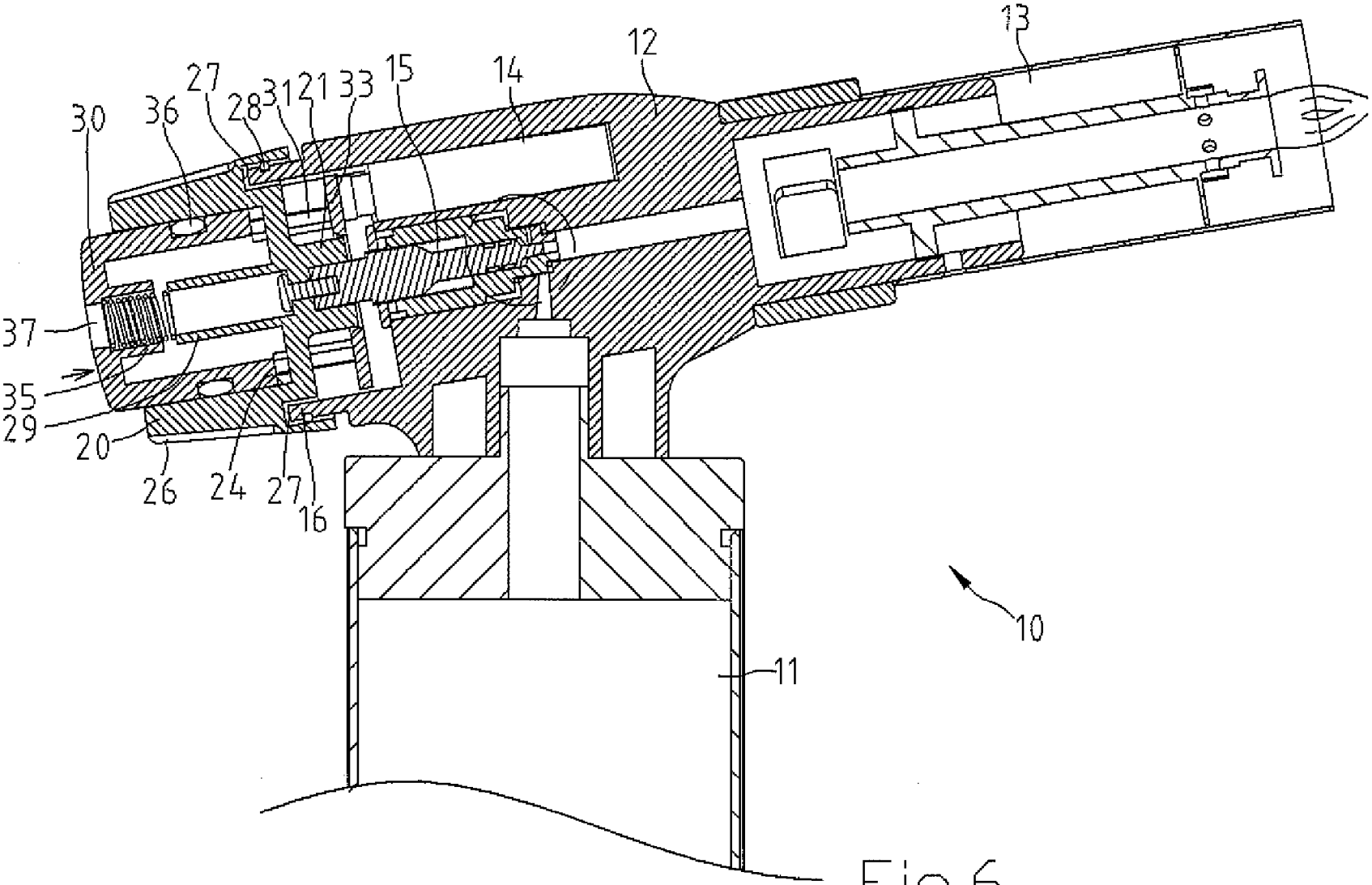
FIG. 6 is similar to FIG. 4, but with the blow torch burner being adjusted to allow combustion gas to be entered and ignited for producing flame.
Figure 8:
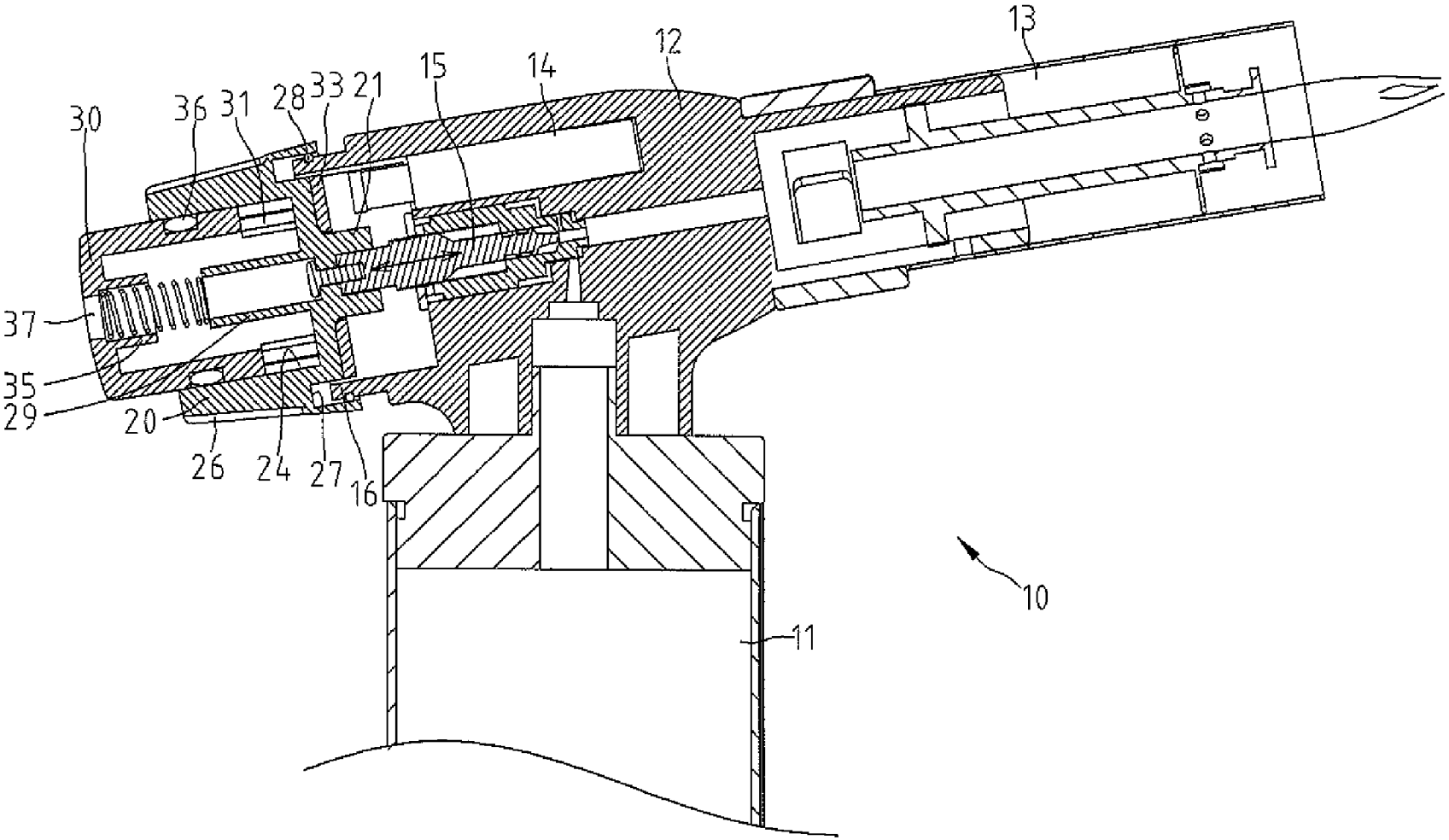
FIG. 8 is similar to FIG. 6, but with the blow torch burner being adjusted for producing an increased length of flame.

Referring to FIGS. 6 and 8, FIG. 6 shows the actuator 30 adapted to be pushed in the direction of the arrow shown for actuating the ignition apparatus 14. FIG. 8 shows the actuator 30 adapted to be biased to its original position by the elastic element 34. As the actuator 30 is pushed, the pushing member 33 is urged into a position to actuate the ignition apparatus 14, thereby igniting the combustion gas. In addition, FIG. 8 also shows the length of the flame is increased, and this is by virtue of the adjusting member 20 is rotated to a state which allows relatively more amount of combustion gas than in FIG. 6 to be fed into the valve seat 12.

From the description above, it is evident that the adjusting member 20 in the present invention will not be accidentally manipulated during operation of the actuator 30, as the adjusting member 20 and the actuator 30 are manipulated separately and pushing the actuator 30 will not impart a rotational force to the adjusting member 20. Thus the adjusting member 20 is not moved.

Furthermore, the friction-providing members 28, 36 are provided for stable operation and are adapted to prevent accidental manipulation of the adjusting member 20 and the actuator.

While the specific embodiments have been illustrated and described, numerous modifications come to mind without significantly departing from the spirit of invention and the scope of invention is only limited by the scope of accompanying claims.

What is claimed is:

1. A blow torch burner which utilizes combustion gas comprising:

a reservoir for maintaining the combustion gas;

a valve seat including an ignition apparatus for igniting the combustion gas and therefore producing a flame;

an adjusting member being connected to said valve seat, and operatively rotatable with respect to said valve seat for controlling amount of the combustion gas fed into said valve seat, said adjusting member including a compartment and a wall portion having a plurality of through holes; and an actuator being received in said compartment and operatively moveable therein for actuating said ignition apparatus, said actuator including a plurality of arms receivable in said through holes respectively so that said actuator is prevented from rotating with respect to said adjusting member.

2. The blow torch burner as claimed in claim 1, wherein said valve seat includes a friction-providing member for providing a friction force between said valve seat and adjusting member.

3. The blow torch burner as claimed in claim 1, wherein said actuator includes a friction-providing member for providing a friction force between said actuator and compartment.

4. The blow torch burner as claimed in claim 2, wherein said friction-providing member is composed of flexible plastic.

5. The blow torch burner as claimed in claim 3, wherein said friction-providing member is composed of flexible plastic.

6. The blow torch burner as claimed in claim 1 further comprising a pushing member engagable with said plurality of arms for actuation of ignition apparatus.

7. The blow torch burner as claimed in claim 6 wherein said pushing member includes a bore receivable by said first joint.

8. The blow torch burner as claimed in claim 1 further comprising an elastic element installed between said adjusting member and actuator, allowing said actuator to longitudinally biasably move with respect to said adjusting member.

9. The blow torch burner as claimed in claim 8, wherein said actuator includes a joint, said adjusting member includes a second joint disposed in said compartment, and said elastic element includes one end engaged with joint of actuator and another end engaged with said second end of adjusting member.

10. The blow torch burner as claimed in claim 1, wherein said adjusting member includes an anti-slip gripping portion, allowing the user to attain in a firm grip during operation of said adjusting member.

11. The blow torch burner as claimed in claim 1, wherein said first joint includes a non-circular orifice receivable by a rod.

12. The blow torch burner as claimed in claim 1 further comprising at least one fastener coupling by adjusting member and a rod.

13. The blow torch burner as claimed in claim 1, wherein said valve seat comprises a rod receivable by said adjusting member for controlling amount of combustion gas fed into said valve seat.

* * * * *